US007377268B2

(12) United States Patent
Lu

(10) Patent No.: US 7,377,268 B2
(45) Date of Patent: May 27, 2008

(54) COMPACT INLINE MAGNETIC FUEL CONDITIONER FOR IMPROVING FUEL EFFICIENCY

(76) Inventor: Min Lu, No. 299 Hulian Road, Baoshan Liuhang Industrial Zone, Shanghai (CN) 201907

( * ) Notice: Subject to any disclaimer, the term of this patent is extended or adjusted under 35 U.S.C. 154(b) by 0 days.

(21) Appl. No.: 11/308,178

(22) Filed: Mar. 9, 2006

(65) Prior Publication Data

US 2007/0209643 A1 Sep. 13, 2007

(51) Int. Cl.
*F02M 33/00* (2006.01)

(52) U.S. Cl. ..... 123/538

(58) Field of Classification Search ..... 123/536–538; 210/222, 695

See application file for complete search history.

(56) References Cited

U.S. PATENT DOCUMENTS 4,538,582 A * 9/1985 Wakuta ..... 123/538
5,055,188 A * 10/1991 Johnston et al. ..... 210/222
5,076,246 A * 12/1991 Onyszczuk ..... 123/538
5,873,353 A * 2/1999 Makita ..... 123/538
6,056,872 A * 5/2000 Glass ..... 210/223
6,361,689 B1 * 3/2002 Munzing ..... 210/222
6,386,187 B1 * 5/2002 Phykitt ..... 123/538
6,405,719 B2 * 6/2002 Nozato ..... 123/538

* cited by examiner

*Primary Examiner*—M. McMahon

(57) ABSTRACT

A compact, inline magnetic fuel conditioner is disclosed for improving fuel efficiency of a fuel combustion engine. The fuel conditioner has a magnetic manifold having a built-in magnetic field for interacting thus conditioning the fuel as it flows by. The magnetic field is produced by several pairs of magnets arranged along the fuel path. The magnetic manifold is sealed within a steel hull. The magnetic manifold increases the fuel surface area and its dwell time for magnetization thus improving the fuel combustion efficiency and reducing undesirable emissions to the environment. The resulting fuel saving lies generally in the range of 5% to 15%. Due to its robust operating principle and construction, the compact magnetic fuel conditioner can be deployed under a wide range of weather conditions. Furthermore, the compact magnetic fuel conditioner can be broadly deployed in gasoline engines, diesel engines and industry fuel kilns.

3 Claims, 9 Drawing Sheets

COMPACT INLINE MAGNETIC FUEL CONDITIONER FOR IMPROVING FUEL EFFICIENCY

The present invention relates generally to the field of automobile accessories. More particularity, the present invention is directed to a device for improving fuel efficiency of an automobile combustion engine.

DESCRIPTION OF THE RELATED ART

Since the popularization of automobiles with combustion engines, a variety of devices have been developed to improve their fuel efficiency that is commonly measured with miles traveled per gallon of fuel consumed. For example, proprietary chemicals have been developed as additives to the fuel tank for this purpose. Another example is the ongoing evolution of sophisticated electronic controller for simultaneously monitoring numerous engine operating parameters while performing an electronically-controlled fuel injection into the combustion chamber. Aside from the obvious advantage of cost saving from an increased gas mileage, another potential advantage of fast growing importance is the accompanying reduction of pollutants emitted from an engine with otherwise less complete fuel combustion.

For further advancement of the art, what is most desirable are fuel saving apparatus that are low cost, compact, easy to install while simultaneously increases gas mileage and reduces pollutant emission.

SUMMARY OF THE INVENTION

A compact, inline magnetic fuel conditioner is proposed to be interposed along a fuel supply path of a fuel combustion engine for improving fuel efficiency. The magnetic fuel conditioner includes:

- an inlet mouth piece for receiving an upstream preconditioned fuel flow.
- an outlet mouth piece for delivering a downstream postconditioned fuel flow.
- a hollow device body connected between the inlet mouth piece and the outlet mouth piece. The hollow device body has an internal magnetic manifold for surrounding the fuel flow while simultaneously imparting a magnetic field so as to magnetically condition the molecular structure of the fuel causing a more complete combustion of the fuel in the fuel combustion engine hence improving its fuel efficiency.

In its simplest form, the magnetic manifold can be implemented with a plurality of permanent magnets for imparting a permanent magnetic field to the fuel. In one embodiment, the permanent magnets are made of a magnetic alloy having at least one component that is a rare earth family element from the periodic table. However, electro magnets can be substituted for these permanent magnets for a similar functionality while providing more controls.

In another embodiment, the magnetic manifold has a plurality of fuel baffles placed along a first side of the fuel flow. Correspondingly, the plurality of permanent magnets are placed along a second side of the fuel flow such that the resultant imparted magnetic field crosses the path of the fuel flow.

In yet another embodiment, each of the fuel baffles is shaped into a thin plate oriented perpendicular to the global direction of the fuel flow. Correspondingly, each of the permanent magnets is shaped into another thin plate matching the fuel baffles so as to form two interleaved arrays arranged along the global direction of the fuel flow. The thus formed interleaved arrays cause the local path of the fuel flow to become zigzag-shaped hence increasing the total path length thus dwell time of the fuel flow under magnetic conditioning without increasing the overall length of the magnetic manifold.

As a refinement for a given total path length of the fuel flow under magnetic conditioning, the spacing between the fuel baffles and the permanent magnets is set to result in a cross-sectional path width of the fuel flow that is:

- as small as possible so as to maximize the intensity of interaction between the fuel and the imparted magnetic field.
- above a minimum allowable value below which the fuel flow rate would otherwise fall below a required level to maintain normal operation of the fuel combustion engine.

In yet another embodiment to maximize the path length of the fuel flow wherein the conditioning magnetic field is substantially perpendicular to the local direction of the fuel flow:

- the magnetization axes of the plurality of permanent magnets are set to be essentially parallel to the global direction of the fuel flow.
- the plurality of permanent magnets are grouped into magnet pairs and within each magnet pair the magnetization directions of neighboring permanent magnets are set to be parallel to each other.
- whereas between neighboring magnet pairs the corresponding magnetization directions are set to be opposing each other.

In yet another embodiment, the magnetic manifold is structured to be essentially cylindrically symmetrical having a cylindrical hull with its cylindrical axis parallel to the global direction of fuel flow. Correspondingly, the plurality of fuel baffles are made to be annular-shaped, placed near the cylindrical surface side of the fuel flow and anchored to the cylindrical hull. The plurality of permanent magnets are made to be disk-shaped, placed near the cylindrical axis side of the fuel flow and anchored to the cylindrical hull.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawing, in which like reference characters designate the same or similar parts throughout the several views, and wherein.

DETAILED DESCRIPTION OF THE PREFERRED EMBODIMENTS

In the following detailed description of the present invention, numerous specific details are set forth in order to provide a thorough understanding of the present invention. However, it will become obvious to those skilled in the art that the present invention may be practiced without these specific details. In other instances, well-known methods, procedures, materials and components have not been described in detail to avoid unnecessary obscuring aspects of the present invention. The detailed description is presented largely in terms of simplified perspective and sectional views. These descriptions and representations are the means used by those experienced or skilled in the art to concisely and most effectively convey the substance of their work to others skilled in the art.

Reference herein to "one embodiment" or an "embodiment" means that a particular feature, structure, or characteristics described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of process flow representing one or more embodiments of the invention do not inherently indicate any particular order nor imply any limitations of the invention.

Figure 1:
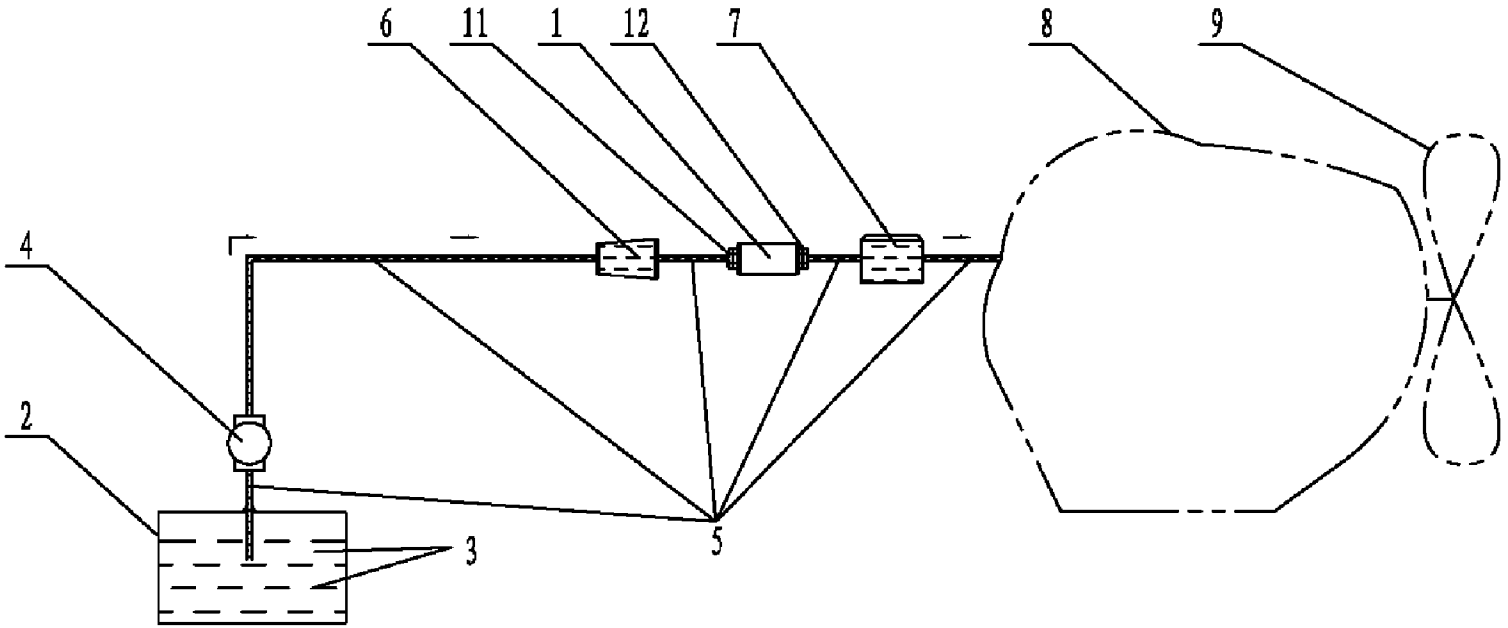
FIG. 1 illustrates the operating configuration of the magnetic fuel conditioner after its installation along a fuel supply path of a fuel combustion engine for improving fuel efficiency.

FIG. 1 illustrates an operating configuration of a compact magnetic fuel conditioner 1 of the present invention after its installation along a fuel supply path 5 of a fuel combustion engine 8 for improving fuel efficiency. In the absence of the magnetic fuel conditioner 1, the traditional fuel supply path 5 includes a serial connection of fuel tank 2, fuel pump 4, fuel filter 6 and carburetor plus fuel injector 7 supporting a corresponding flow of fuel 3 from the fuel tank 2 into the fuel combustion engine 8 having a cooling fan 9. The magnetic fuel conditioner 1 of the present invention is interposed along the fuel supply path 5 and connected between the fuel filter 6 and the carburetor plus fuel injector 7 via an upstream connection point 11 and a downstream connection point 12. In operation, the magnetic fuel conditioner 1 magnetically conditions the fuel 3 thus causing a more complete combustion of the fuel 3 in the fuel combustion engine 8 hence improving its fuel efficiency. While for an automobile or a motorcycle it is recommended to install the magnetic fuel conditioner upstream of the carburetor along the gas line, for a diesel engine the compact magnetic fuel conditioner should be installed either upstream of the high pressure diesel fuel pump or downstream of the diesel fuel filter along the gas line. Details of the magnetic fuel conditioner 1 internal structures and their resulting magnetic conditioning of the fuel 3 will be presently described.

Figure 2:
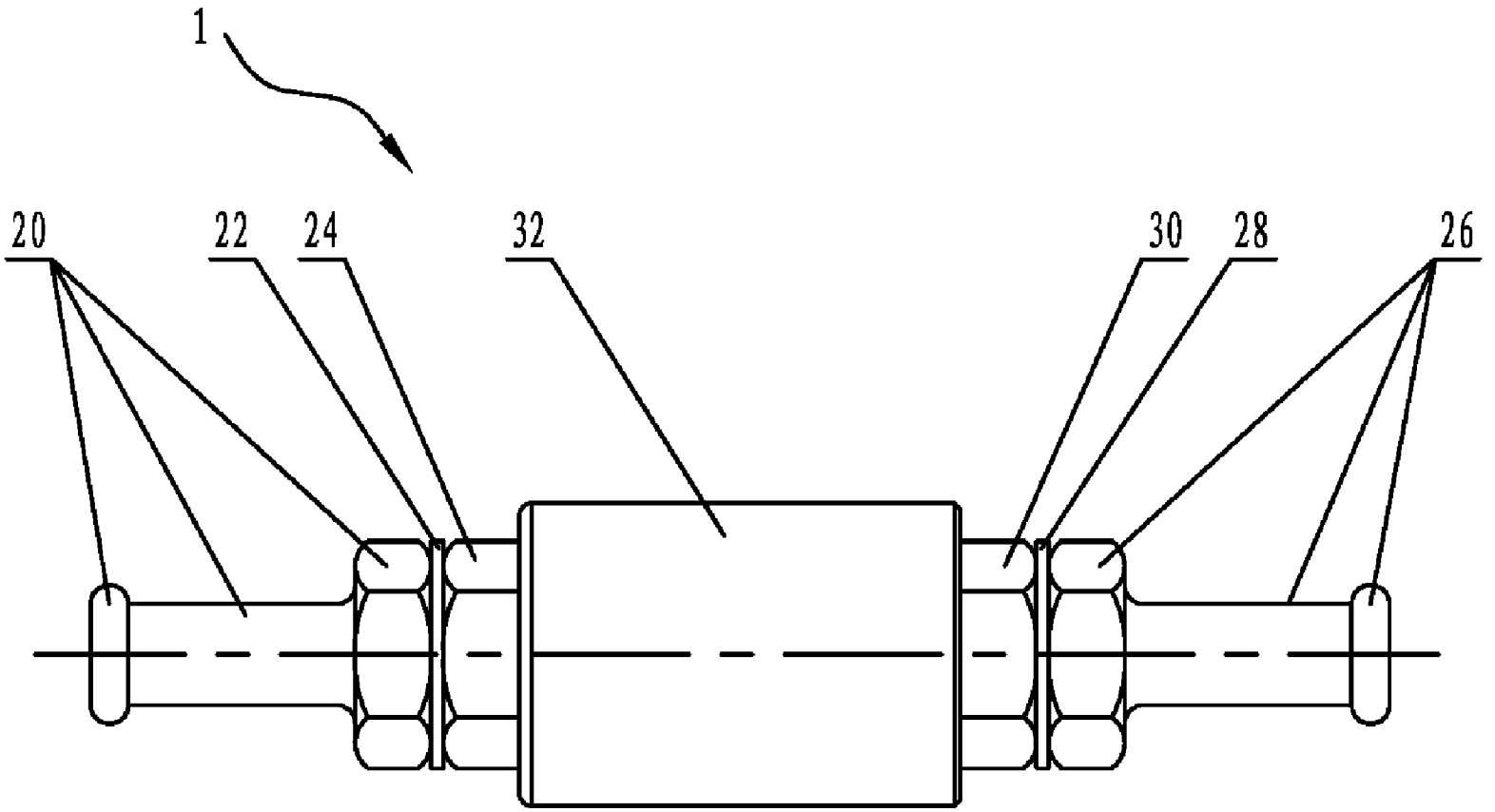
FIG. 2 is an external side view of one embodiment of the magnetic fuel conditioner.

FIG. 2 is an external side view of one embodiment of the magnetic fuel conditioner 1 having an inlet mouth piece 20, fluidically coupled to the upstream connection point 11 of the fuel supply path 5, for receiving a pre-conditioned fuel flow from the fuel filter 6. The magnetic fuel conditioner 1 also has an outlet mouth piece 26, fluidically coupled to the downstream connection point 12 of the fuel supply path 5, for delivering post-conditioned fuel flow to the carburetor plus fuel injector 7. A hollow device body 32 is disposed between and in fluidic communication with the inlet mouth piece 20 and the outlet mouth piece 26 for accommodating a fuel flow in between. The fluidic communication with the inlet mouth piece 20 is sealed against leakage with an inlet cover 24 and an inlet end seal 22. Likewise, the fluidic communication with the outlet mouth piece 26 is sealed against leakage with an outlet cover 30 and an outlet end seal 28.

Figure 3:
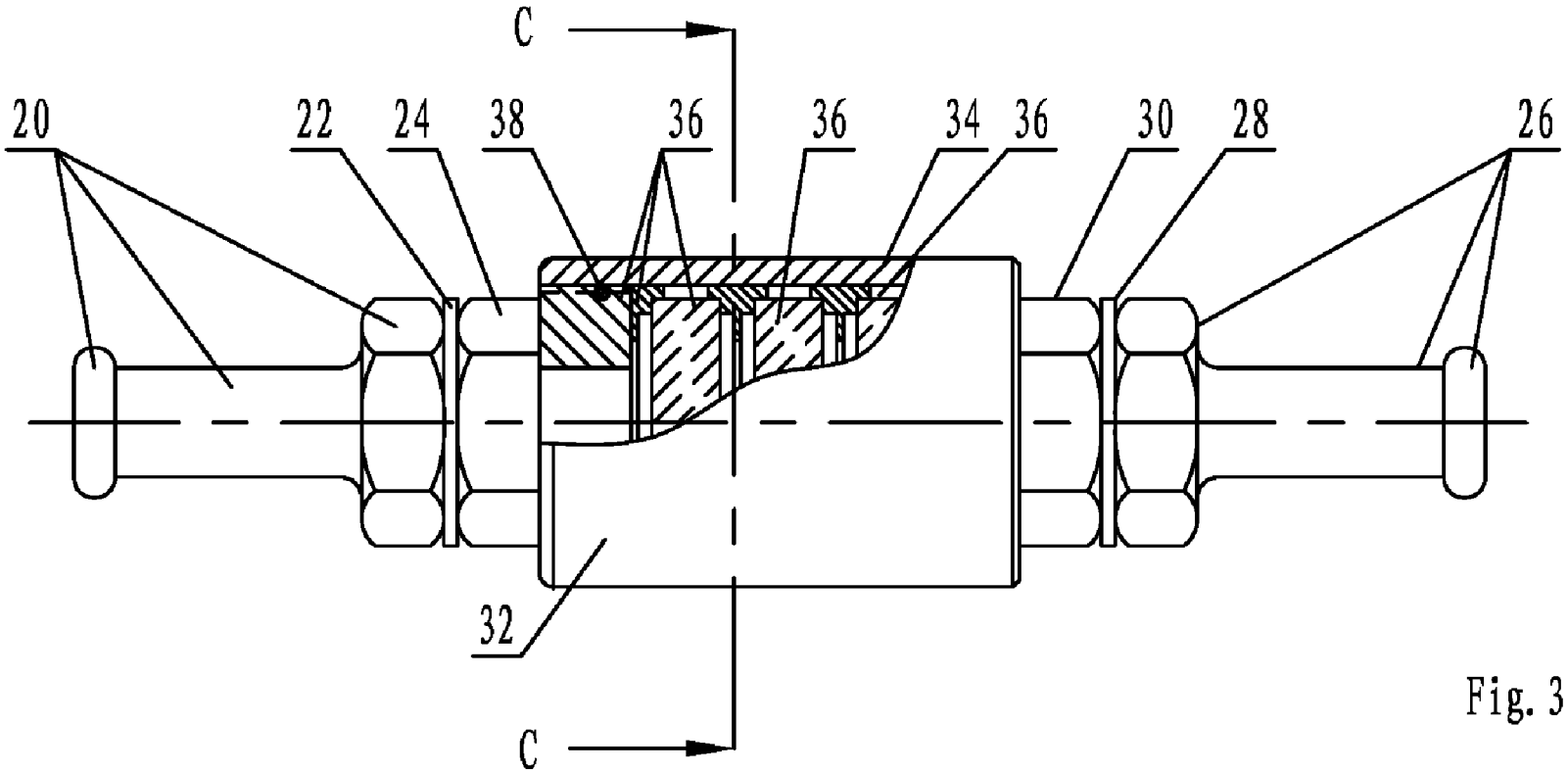
FIG. 3 is the same as FIG. 2 except with a partial cut-away of the magnetic fuel conditioner body revealing a magnetic manifold inside.
Figure 4:
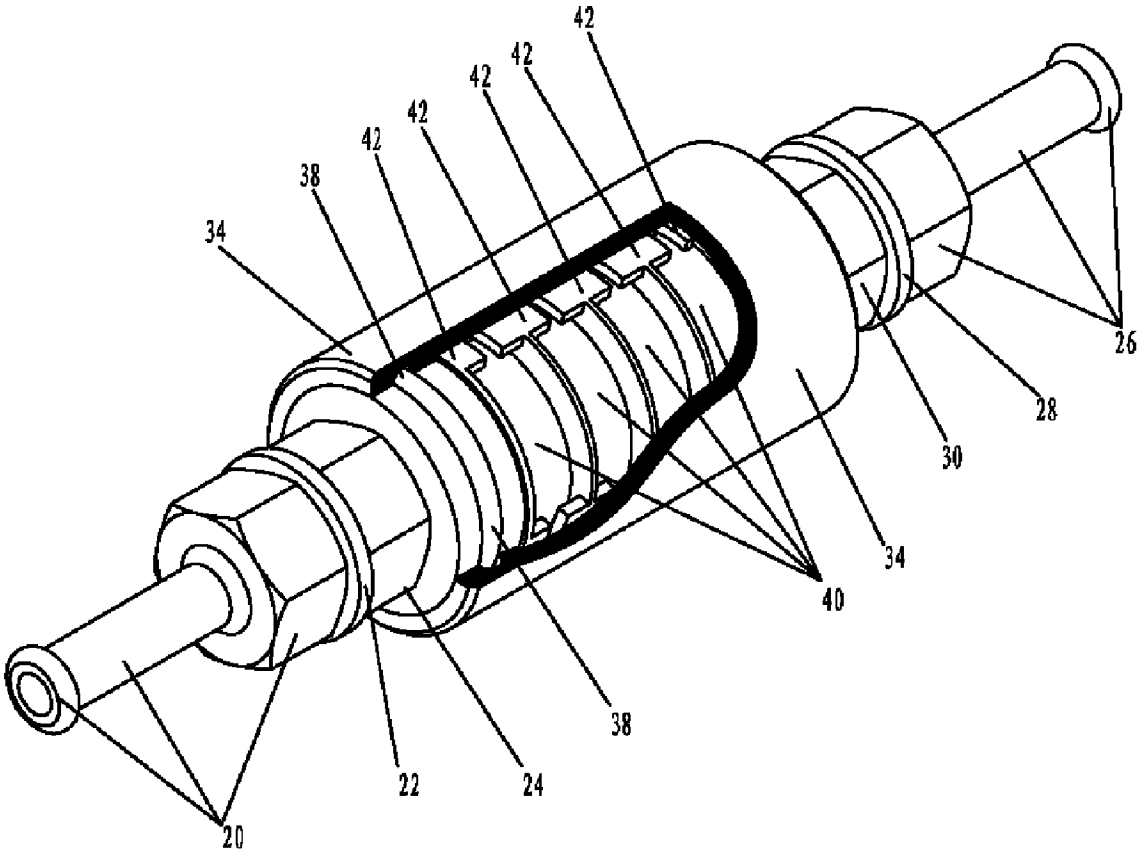
FIG. 4 is similar to FIG. 3 with a perspective view illustrating an embodiment of the magnetic manifold that is essentially cylindrically symmetrical in structure.

FIG. 3 and FIG. 4 are the same as FIG. 2 except with partial cut-away side and perspective views of the hollow device body 32 revealing a magnetic manifold 36 inside. As seen, the illustrated embodiment of the magnetic manifold 36 is essentially cylindrically symmetrical in structure and is enclosed in a cylindrical hull 34. The cylindrical axis of the cylindrical hull 34 is parallel to the global direction of fuel flow. Therefore, the magnetic manifold 36 structurally surrounds the fuel flow. To facilitate insertion of the magnetic manifold 36 into the cylindrical hull 34 resulting in a leak-free assembly of the magnetic fuel conditioner 1, a seal O-ring 38 is provided between the magnetic manifold 36 and the cylindrical hull 34 near the inlet. The magnetic manifold 36 includes a plurality of permanent magnets 40 for imparting a permanent magnetic field to the fuel flow. The permanent magnets 40 are, in this case, disk-shaped, placed near the cylindrical axis side of the fuel flow and are anchored to the cylindrical hull 34 through a corresponding number of permanent magnet anchor 42.

Figure 5A:
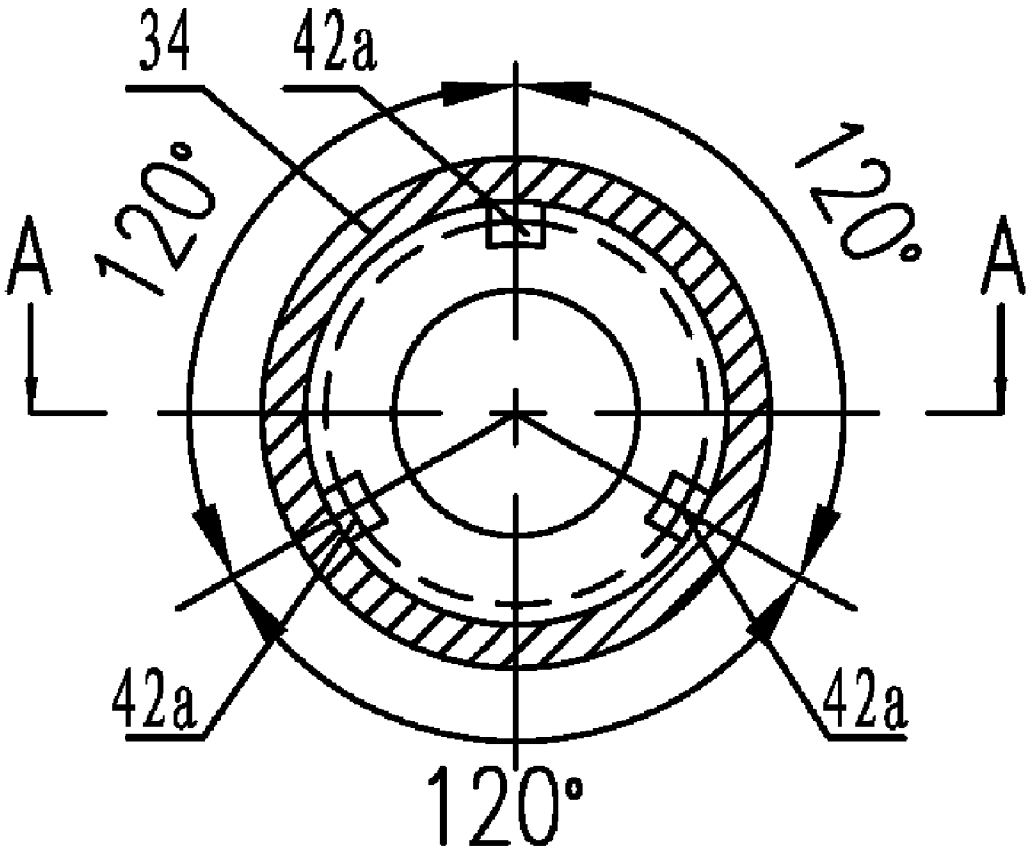
FIG. 5A illustrates a first transverse cross section of the magnetic manifold.
Figure 5B:
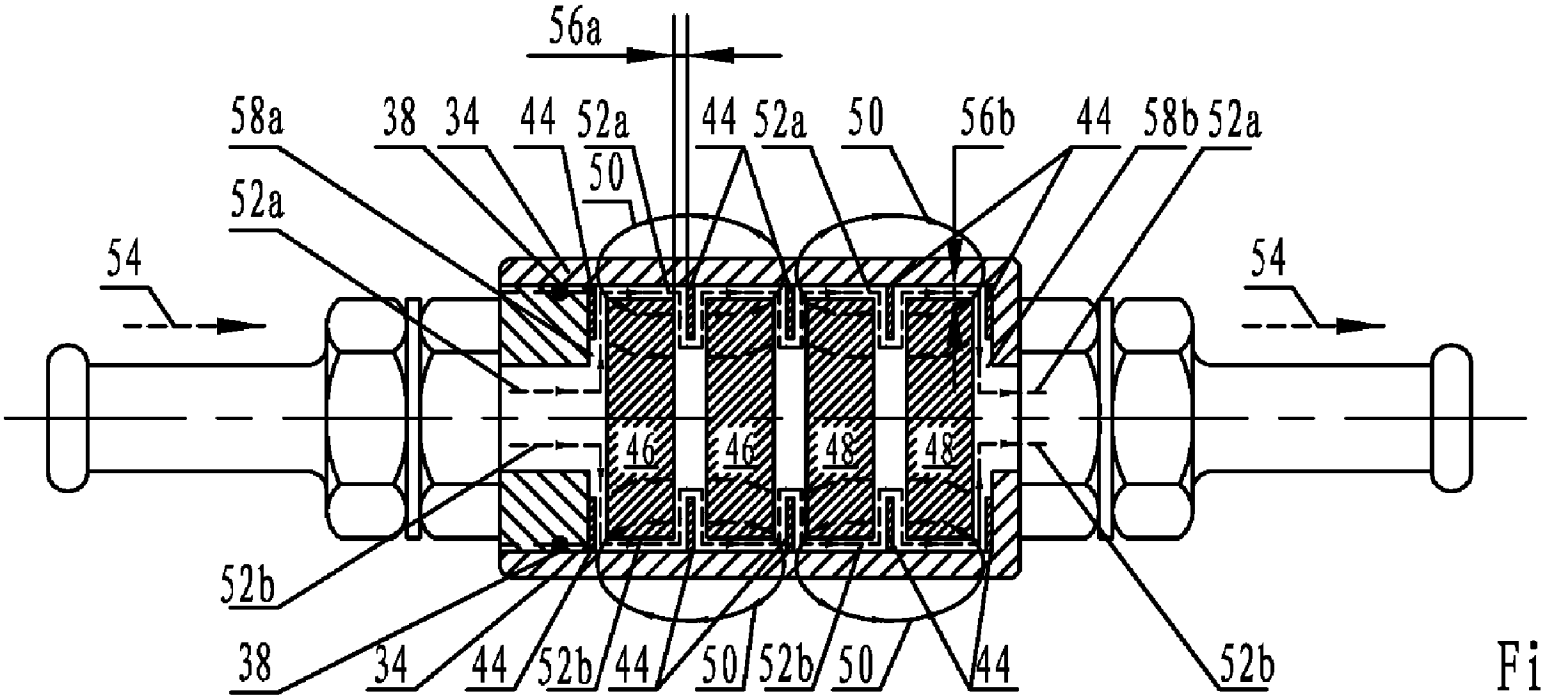
FIG. 5B is a partial longitudinal cross section of the magnetic manifold taken along a section from FIG. 5A.

FIG. 5A illustrates a first transverse cross section of the magnetic manifold 36 and FIG. 5B is a partial longitudinal cross section of the magnetic manifold 36 taken along a section A-A from FIG. 5A. The plurality of permanent magnets are now illustrated as permanent magnet elements 46 and permanent magnet elements 48 with opposing magnetization directions and this will be presently described in more details. Correspondingly, the permanent magnet elements 46 and 48 together impart a field of magnetic flux 50 in their vicinities. The permanent magnet elements 46 and 48 are affixed to the cylindrical hull 34 via permanent magnet anchors 42*a*. While the global direction of the fuel flow 54 is straightforward as indicated, the detailed local paths 52*a* and 52*b* of the fuel flow inside the magnetic manifold 36 is zigzag-shaped. This is because each of the local paths 52*a* and 52*b* is surrounded by a plurality of fuel baffles 44 placed along the external side of the fuel flow and the permanent magnet elements 46 and 48 placed along the internal side of the fuel flow. Given the cylindrical symmetry of the magnetic manifold 36, the fuel baffles 44 are annular-shaped and also anchored to the cylindrical hull 34. In essence, two interdigitated arrays are formed and arranged along the global direction 54 of the fuel flow while the same interdigitated arrays mechanically deflect the fuel flow periodically. By the same token, the imparted magnetic field, as illustrated with the field of magnetic flux 50, crosses the local paths 52*a* and 52*b* of the fuel flow. Notice that, to limit the overall length of the magnetic manifold 36, each of the fuel baffles 44 is shaped into a thin plate oriented perpendicular to the global direction 54 of the fuel flow and, correspondingly, each of the permanent magnets 46 and 48 is also, as much as possible without losing significant magnetic strength, shaped into another thin plate matching the fuel baffles 44. As a remark of clarification, the local path 52*a* starts at point 58*a* and ends at point 58*b*, and similarly for the local path 52*b*.

As the magnetic flux 50 crosses the local paths 52*a* and 52*b* of the fuel flow, the imparted magnetic field causes magnetization thus conditions the molecular structure of the fuel 3 into tiny molecular particles of Carbon-Hydrogen compound. That is, the fuel molecules get magnetized into microscopic particles of the order of nanometer in size. The conjectured underlying mechanism is that the strong magnetic field successively fractures large oil molecules into microscopic, nanometer-sized molecules. These microscopic molecules are further magnetically polarized before they get orderly introduced into the fuel combustion engine 8 chamber for nearly full combustion with increased combustion rate thus fuel utilization efficiency. The now conditioned fuel 3 becomes easier to atomize, easier to combine with Oxygen molecule, easier to evaporate after attaching to the engine chamber wall, thus increasing the combustion efficiency. Additionally, the conditioned fuel 3 speeds up the flame propagation speed and promotes the decomposition of Carbon-Hydrogen compound, ultimately results in a more complete combustion of the fuel oil with greater heat generation. Concomitantly, the conditioned fuel 3 also reduces the exhaustion of harmful materials, raises the energy utilization rate while reducing environmental contamination. It is recognized that the underlying functional mechanism is quite complicated with many unknowns remain to be investigated. Nevertheless, as will also be presently demonstrated, the magnetic fuel conditioner 1 of the present invention has been experimentally proven to function dependably following easy installation and simple utilization.

Two major design factors warrant special considerations here. The first factor is a sufficient level of magnetic field strength and this is limited by the availability of strong magnetic material. The second factor is the fuel flow route and associated dwell time of the fuel flow under magnetic conditioning. For the first design factor, the permanent magnets 46 and 48 can be made of a magnetic alloy having at least one component that is a rare earth family element from the periodic table. More specifically, they can be made of a Neodymium-Iron-Boron magnetic alloy or a Samarium-Cobalt magnetic alloy. For those skilled in the art, an alternative embodiment of these permanent magnets 46 and 48 can be electromagnets driven by a suitable external electrical supply. The advantage here would be more controls at the expense of added complexity to the magnetic fuel conditioning system. For the second design factor, the aforementioned two interdigitated arrays function to significantly lengthen the local paths 52*a* and 52*b* of the fuel flow route while simultaneously increasing the exposure of the fuel 3 to the conditioning magnetic flux 50 without significantly increasing the overall length of the magnetic fuel conditioner 1. This increases the strength and dwell time of interaction between the fuel oil and the conditioning magnetic field. To further increase the interaction between the fuel flow and the magnetic flux 50 hence correspondingly improving the fuel efficiency, the cross-sectional path width 56*a* and cross-sectional path width 56*b* should preferably be made as small as possible by selecting proper spacings between the permanent magnets 46, 48 and the fuel baffles 44 and proper spacings between the permanent magnets 46, 48 and the cylindrical hull 34. However, for a given total path length of the local path 52*a* (and similarly local path 52*b*) under magnetic conditioning, the cross-sectional path width 56*a* and 56*b* could not be made below a minimum allowable value below which the fuel flow rate would otherwise, due to excessive flow impedance, fall below a required level to maintain normal operation of the fuel combustion engine 8. In practice, for a total path length of the fuel flow under magnetic conditioning in the range of from about 30 mm to about 200 mm, the cross-sectional path width 56*a* and 56*b* should be in the range of from about 1 mm to about 1.5 mm.

Yet another important aspect of the present invention is the orientation of the magnetization direction of the various permanent magnet elements 46 and 48. As illustrated in FIG. 5B, two pairs of permanent magnets are disposed along the general direction and path of fuel flow. As a result, the magnetization axes of the plurality of permanent magnets 46 and 48 are set to be essentially parallel to the global direction 54 of the fuel flow. Within each pair, for example the pair 46 and 46, the neighboring magnets are attracted toward each other as their respective neighboring pole faces have opposite polarity. The same applies to the pair 48 and 48. However, between the two pairs the polarities of the magnets are arranged such that the neighboring magnets are repulsive to each other as their respective neighboring pole faces have the same polarity. This is illustrated with the middle permanent magnets 46 and 48. This results in a magnetic field distribution, along the global direction 54 of fuel flow, whose magnetization polarity alternates between the two neighboring pairs hence repeatedly intersecting the local path 52*a* and local path 52*b* of fuel flow route along their entire path within the magnetic fuel conditioner 1. In this way, the path length of the fuel flow wherein the conditioning magnetic flux 50 is substantially perpendicular to the local direction of the fuel flow gets maximized. This practice is known to further maximize the effectiveness of magnetic conditioning of the fuel 3.

Figure 6A:
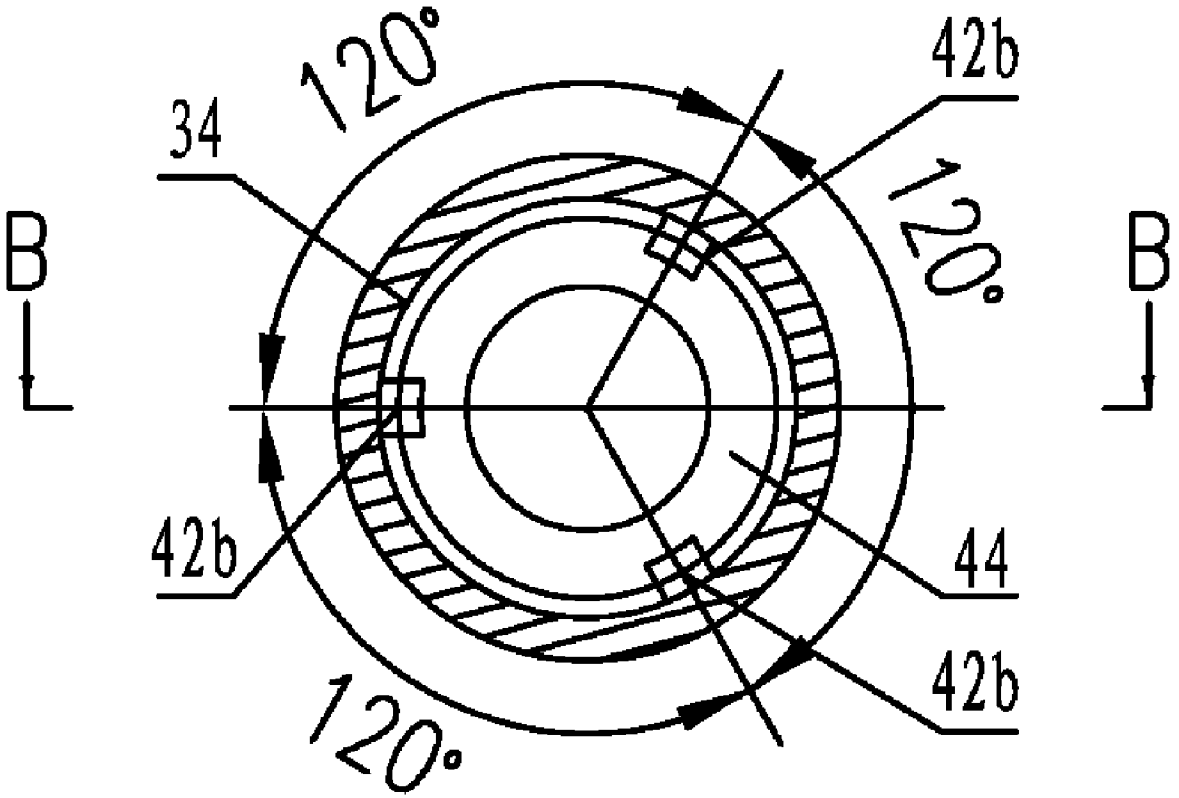
FIG. 6A illustrates a second transverse cross section of the magnetic manifold.
Figure 6B:
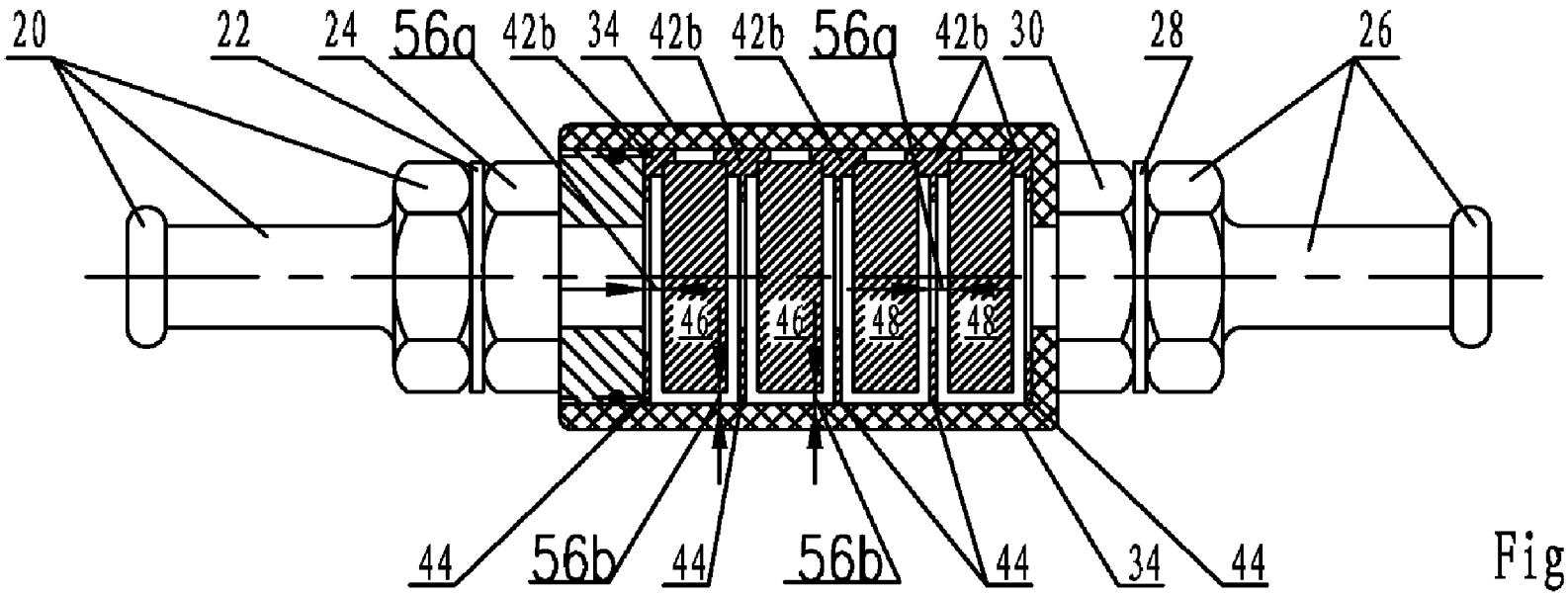
FIG. 6B is a partial longitudinal cross section of the magnetic manifold taken along a section from FIG. 6A.

FIG. 6A illustrates a second transverse cross section of the magnetic manifold 36 and FIG. 6B is a partial longitudinal cross section of the magnetic manifold 36 taken along a section B-B from FIG. 6A. As described before, the annular-shaped fuel baffles 44 are anchored to the cylindrical hull 34 via a number of fuel baffle anchors 42*b*.

To ascertain its ability to improve the fuel efficiency, the compact magnetic fuel conditioner 1 of the present invention is installed in test vehicles and the test vehicles are driven at constant speed and under various acceleration dynamics for a substantial total distance, their corresponding fuel-consumption are then measured. As an example, compared to otherwise test vehicles without the magnetic fuel conditioner 1, after the test vehicles with the magnetic fuel conditioner 1 have been driven for 300 kilometers (KM), the following fuel savings were recorded:

| | |
|---|---|
| suburban area driving: | 8.7% |
| metropolitan area driving: | 4.5% |

Meanwhile, the acceleration dynamics of the test vehicles remains similar to those without the magnetic fuel conditioner 1 of the present invention.

Figure 7:
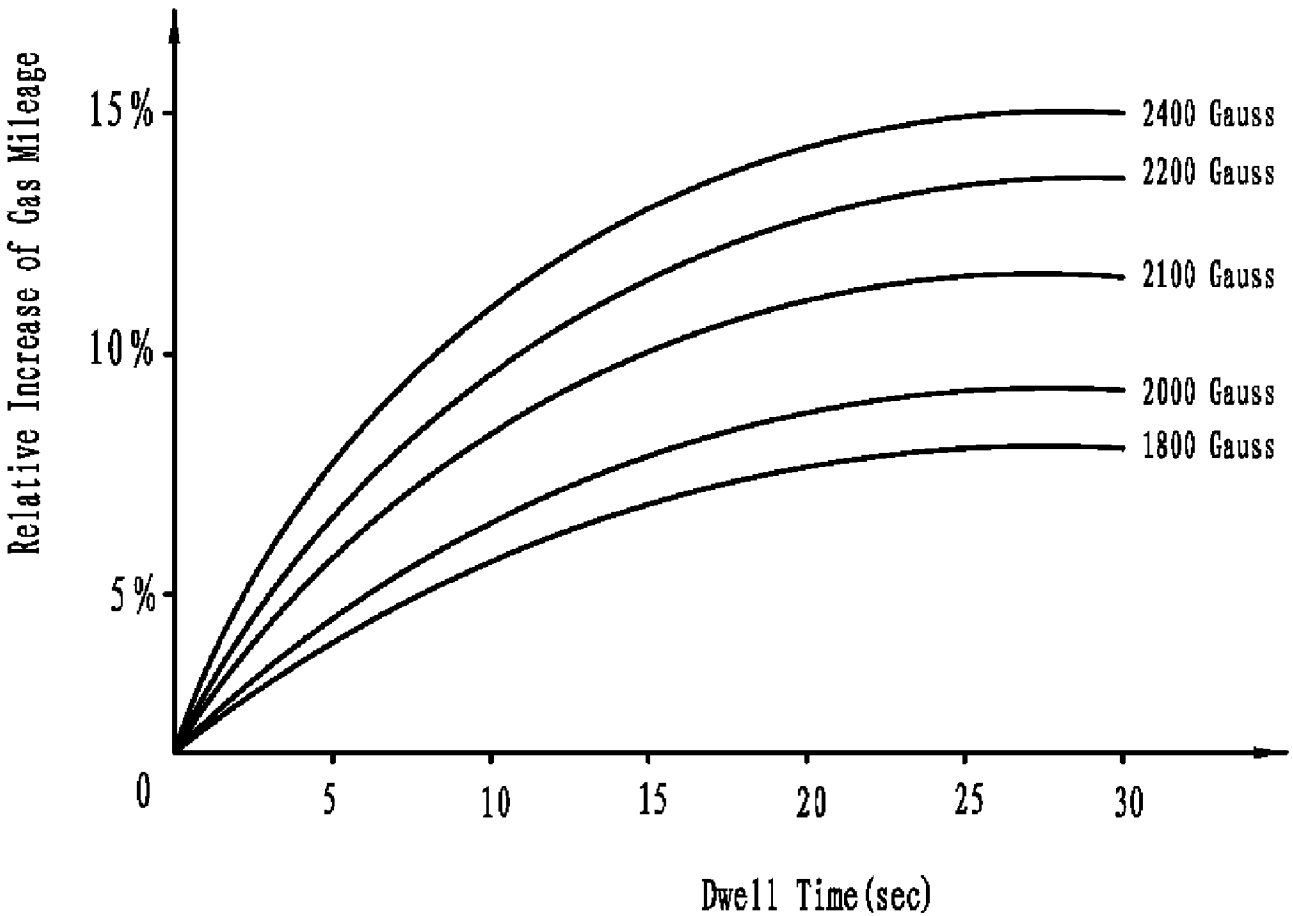
FIG. 7 is a family of curve-fitted experimental data illustrating the increased gas mileage of test vehicles equipped with the magnetic fuel conditioner of the present invention.

FIG. 7 is a family of curve-fitted experimental data illustrating the correspondingly increased gas mileage of test vehicles equipped with the magnetic fuel conditioner 1 of the present invention. The horizontal axis is Dwell Time in unit of seconds, the total time the fuel 3 spends inside the magnetic fuel conditioner 1 under magnetic conditioning, approximately between point 58*a* and point 58*b* of FIG. 5B. The vertical axis is Relative Increase of Gas Mileage in unit of percent (%). The various members of the curve family correspond to their respective conditioning magnetic field strength in unit of Gauss, as imparted by the permanent magnets 46 and 48 of FIG. 5B. While a higher conditioning magnetic field strength clearly provides a correspondingly higher improvement of gas mileage, the maximum magnetic field strength tends to be limited by the material property of the available magnetic alloy making up the permanent magnets. Also, below certain Dwell Time, say around 10 seconds, a high conditioning magnetic field strength alone can not produce significant improvement of gas mileage. On the other hand, above certain Dwell Time, say around 30 seconds, the improvement of gas mileage tends to become saturated with diminishing return. In view of these observations and tradeoffs, in practice a preferred embodiment of the magnetic fuel conditioner 1 is one structured to yield a conditioning magnetic field strength of from about 2000 Gauss to about 2200 Gauss and a dwell time of from about 15 second to about 25 second.

As described with numerous exemplary embodiments, a compact magnetic fuel conditioner has been described for improving fuel efficiency of a fuel combustion engine. However, for those skilled in this field, these exemplary embodiments can be easily adapted and modified to suit additional applications without departing from the spirit and scope of this invention. For example, for those skilled in the art, it should become clear by now that the structure of the magnetic manifold does not have to be cylindrically symmetrical. The structure can have a square, an elliptical or a rectangular cross section instead. The structure can even be made non-straight such as helical. Thus, it is to be understood that the scope of the invention is not limited to the disclosed embodiments. On the contrary, it is intended to cover various modifications and similar arrangements based upon the same operating principle. The scope of the claims, therefore, should be accorded the broadest interpretations so as to encompass all such modifications and similar arrangements.

What is claimed is:

1. A compact inline magnetic fuel conditioner, interposed along a fuel supply path of a fuel combustion engine for improving fuel efficiency, the magnetic fuel conditioner comprising:

an inlet mouth piece, fluidically coupled to an upstream connection point of the fuel supply path, for receiving pre-conditioned fuel flow there from;

an outlet mouth piece, fluidically coupled to a downstream connection point of the fuel supply path, for delivering post-conditioned fuel flow there to; and a hollow device body disposed between and in fluidic communication with said inlet mouth piece and said outlet mouth piece for accommodating a fuel flow there between, said hollow device body further comprises an internal magnetic manifold for surrounding the fuel flow while simultaneously imparting a magnetic field there to so as to magnetically condition the molecular structure of the fuel thereby cause a more complete combustion of the fuel in the fuel combustion engine hence improving its fuel efficiency;

wherein said magnetic manifold further comprises a plurality of permanent magnets such that the resultant imparted magnetic field is a permanent magnetic field; wherein said magnetic manifold further comprises a plurality of fuel baffles placed along a first side of the fuel flow and, correspondingly, said plurality of permanent magnets are placed along a second side of the fuel flow such that the resultant imparted magnetic field crosses the path of the fuel flow; wherein each of said fuel baffles is further shaped into a thin plate oriented perpendicular to the global direction of the fuel flow and, correspondingly, each of said permanent magnets is further shaped into another thin plate matching said fuel baffles so as to form two interleaved arrays, arranged along the global direction of the fuel flow, thereby cause the local path of the fuel flow to become zigzag-shaped hence increasing the total path length thus dwell time of the fuel flow under magnetic conditioning without increasing the overall length of the magnetic manifold;

wherein said magnetic manifold is structured to be essentially cylindrically symmetrical having a cylindrical hull with its cylindrical axis parallel to the global direction of fuel flow;

the plurality of fuel baffles being annular-shaped, placed near the cylindrical surface side of the fuel flow and anchored to the cylindrical hull; and the plurality of permanent magnets being disk-shaped, placed near the cylindrical axis side of the fuel flow and anchored to the cylindrical hull.

2. The inline magnetic fuel conditioner of claim 1 wherein said magnetic manifold is structured to yield a conditioning magnetic field strength of from about 2000 Gauss to about 2200 Gauss and a dwell of time from about 15 second to about 25 second.

3. The inline magnetic fuel conditioner of claim 1 wherein said magnetic manifold is structured to yield a cross-sectional path width of the fuel flow of from about 1 mm to about 1.5 mm and a total length of the fuel flow under magnetic condition of from about 30 mm to about 200 mm.

* * * * *